US007565890B2

(12) United States Patent
Keller et al.

(10) Patent No.: US 7,565,890 B2
(45) Date of Patent: Jul. 28, 2009

(54) RAIL USED AS A TORSIONAL STOP FOR THE VALVE TRAIN OF AN INTERNAL COMBUSTION ENGINE, AND ROLLER TAPPET ARRANGEMENT

(75) Inventors: Hermann Keller, Lauingen (DE); Roland Krapp, Wattendorf (DE)

(73) Assignee: Schaeffler KG, Herzogenaurach (DE)

( * ) Notice: Subject to any disclaimer, the term of this patent is extended or adjusted under 35 U.S.C. 154(b) by 206 days.

(21) Appl. No.: 11/772,408

(22) Filed: Jul. 2, 2007

(65) Prior Publication Data

US 2007/0283910 A1 Dec. 13, 2007

Related U.S. Application Data

(62) Division of application No. 10/539,812, filed as application No. PCT/EP03/14297 on Dec. 16, 2003, now Pat. No. 7,275,507.

(30) Foreign Application Priority Data

Dec. 18, 2002 (DE) ..... 102 59 128
Dec. 18, 2002 (DE) ..... 102 59 129

(51) Int. Cl.
*F01L 1/14* (2006.01)

(52) U.S. Cl. ..... 123/90.5; 123/90.42; 123/90.48; 74/569

(58) Field of Classification Search ..... 123/90.39, 123/90.42, 90.44, 90.48, 90.5, 90.52, 90.55, 123/90.65, 90.66, 90.67; 74/559, 567, 569
See application file for complete search history.

(56) References Cited

U.S. PATENT DOCUMENTS 5,088,455 A 2/1992 Moretz (Continued)

FOREIGN PATENT DOCUMENTS

DE 680958 9/1939

(Continued)

*Primary Examiner*—Ching Chang
(74) *Attorney, Agent, or Firm*—Volpe and Koenig, P.C.

(57) ABSTRACT

A rail used as a torsional stop for the valve train of an internal combustion engine is disclosed. The rail includes spaces (10) which are arranged in a row spaced apart at a distance from one another within the rail (8) and accommodate inserted valve lifters provided as roller tappets (9). Two parallel torsional stop areas (15) are configured on the outer surface of each roller tappet (9) in the form of planar flattened zones in order to secure the roller tappet (9) against rotation about the central longitudinal axis thereof. The torsional stop areas (15) rest against guide areas of the rail (8), which are located inside the associated accommodating space (10). An insertion opening, indicated as a keyhole (11), into which the respective roller tappet (9) is inserted in a direction of the longitudinal axis thereof before being displaced parallel to the axis towards the guide areas of the rail (8) used as the torsional stop and then once again being moved in the axial direction, is assigned to the accommodating space (10) of the rail (8). A protruding catch is disposed in the area of the recess (10) of the rail while a radial groove (17), which engages around the catch of the rail (8) when the roller tappet (9) is displaced parallel to the axis thereof, is incorporated into the roller tappet (9) in a region of the torsional stop area.

4 Claims, 7 Drawing Sheets

U.S. PATENT DOCUMENTS

| | | | |
|---|---|---|---|
| 5,263,386 | A | 11/1993 | Campbell et al. |
| 5,307,769 | A | 5/1994 | Meagher et al. |
| 6,257,189 | B1 | 7/2001 | Moretz et al. |
| 6,328,009 | B1 | 12/2001 | Brothers |
| 6,357,407 | B2 | 3/2002 | Brothers |
| 6,405,699 | B1 | 6/2002 | Church |
| 6,978,752 | B2 | 12/2005 | Albertson et al. |
| 6,994,064 | B2 | 2/2006 | Haas et al. |
| 7,311,074 | B2 * | 12/2007 | Sailer et al. ..... 123/90.5 |
| 2002/0185095 | A1 | 12/2002 | Karbstein et al. |
| 2006/0278184 | A1 | 12/2006 | Barth et al. |

FOREIGN PATENT DOCUMENTS

| | | |
|---|---|---|
| DE | 3039946 | 12/1982 |
| DE | 19712610 | 11/1997 |

* cited by examiner

RAIL USED AS A TORSIONAL STOP FOR THE VALVE TRAIN OF AN INTERNAL COMBUSTION ENGINE, AND ROLLER TAPPET ARRANGEMENT

CROSS-REFERENCE TO RELATED APPLICATIONS

This application is a divisional of U.S. patent application Ser. No. 10/539,812, filed Feb. 9, 2006, now allowed, which is the U.S. National Phase of PCT/EP03/14297, filed Dec. 16, 2003, which claimed the benefit of DE 102 59 129.6 and DE 102 59 128.8, both filed Dec. 18, 2002.

BACKGROUND

The invention relates to a rail used as an anti-rotation guide for the valve drive of an internal combustion engine having receiving spaces, which are arranged in a row at a distance from one another within the rail and accommodate inserted valve lifters that are provided as roller tappets with two parallel anti-rotation guide areas being formed on the outer surface of each roller tappet in the form of planar flattened zones, which rest on guide areas of the inventive rail provided inside the corresponding accommodating space and with the accommodating space of the inventive rail having an insertion opening in the form of a key hole, into which the respective roller tapped is inserted in the direction of its longitudinal axis, subsequently axially shifted towards the guide areas of the inventive rail serving as the anti-rotation guide and then again be displaced in the axial direction.

Such a guide rail is used in internal combustion engines in order to prevent the rotation of valve lifters embodied as roller tappets. Simultaneously it serves as an assembly aid and can be used particularly for the roller tappets of a push rod valve drive.

The publication DE 197 12 610 A1, which shows a guide rail for an internal combustion engine, explains that usually internal combustion engines are provided with roller valve lifters, which engage protrusions on camshafts. Due to the fact that the tappets must not rotate around their longitudinal axis because the rolls at the tappets are to remain at the same plane as the protrusions on the cam shaft, the tappets are aligned in a suitable manner in the cylinder block of the internal combustion engine by way of certain holding devices, preventing their rotation.

A guide rail 1, according to a prior proposal of the present applicant, shown in FIG. 5 in the attached drawing, is provided with several spaces 2, arranged in a row at a distance from one another for accepting the valve lifters 3. Two spaces 2 each are arranged as a pair and connected via an insertion bore 4, through which a valve lifter 3, which is provided with a trumpet-shaped end 5, can be inserted. The valve lifter 3 is provided with flattened zones at its exterior surface. Said flattened zones cooperate with the flattened zones 6 of the guide rail 1, which are allocated inside the spaces 2, when the valve lifter 3, inserted into the insertion bore 4, are displaced from there into one of the two spaces 2, which are arranged in pairs. During said motion, the longitudinal axis of the valve lifter 3 is shifted parallel. Now, the flattened zone of the valve lifter 3 and the flattened zones 6 of the guide rail 1 support one another so that a rotation around the longitudinal axis of the valve lifter 3, held by the guide rail 1, is not possible.

After the displacement out of the insertion bore 4 into the space 2, the valve lifter 3 is pulled downward in the direction of its longitudinal axis. Here, the trumpet-shaped end 5 of the valve lifter 3 enters recesses 7 of the guide rail 1, formed in the shape of a segment of a circle, and which are allocated to each of the spaces 2. In this manner, any movement of the valve lifter 3 back into the insertion bore 4 is prevented. When the guide rail 1 is completely equipped with valve lifters 3, it can be mounted to the internal combustion engine.

SUMMARY

The invention is based on the objective of providing an assembly of roller tappets and an inventive rail, which ensure a precise alignment of the tappets in the rail and, thus, the motor as well, as required for a switchable roller tappet. Such tappets must be assembled in the motor block in a defined manner, i.e., the switching mechanism of said tappets must be on the side of the switching oil gallery. The tappets must be non-rotatable in their mounted position. The inventive rail is provided such that it can be assembled as a component including six tappets. Additionally, this must be limited to one position only and to one side of the motor block. The tappets are to be held in the inventive rail in order to prevent them from falling out too easily.

It is suggested according to the invention to arrange a protruding nose or catch on the inventive rail in the area of the recess, and to provide the roller tappets with a radial groove in the area of the anti-rotation guide area, which encompasses the catch of the inventive rail during the displacement of the roller tappet in the direction parallel to its axis.

According to another proposal, in an inventive rail for the valve train of an internal combustion engine, in which the rail comprises circular cylindrical spaces arranged in a row spaced apart at a distance from one another for accepting inserted valve lifters provided as roller tappets with a rectangular piece being mounted according to the invention on each of the roller tappets for preventing its rotation around its central longitudinal axis, said piece surrounding the roller tappet, with two parallel longitudinal sides of the piece acting as anti-rotation guide areas of the roller tappets inserted in the space engaging the guide surfaces of the inventive rail.

Finally the invention relates to an arrangement of roller tappets in an inventive rail for the valve train of an internal combustion engine, having spaces arranged in a row spaced apart at a distance from one another for accepting inserted valve lifters provided as roller tappets, with a anti-rotation guide area being provided at each roller tappet to prevent any rotation around its central longitudinal axis, which is supported at a guide area of the inventive rail, located inside the corresponding space, and with an insertion opening being allocated to the accepting space in the form of a key hole, into which the respective roller tappet is inserted in the direction of its longitudinal axis, subsequently displaced axially parallel towards the space and then again shifted in the axial direction. Here, it is suggested according to the invention that the anti-rotation guide area of the roller tappet is formed by a bent metal strip of a spring support, which is arranged at the back end of the roller tappet, facing away from the tappet roller.

The inventive rail may be formed with a U-shaped cross-section having a U-web and 2 U-legs, with the guidance surface for the roller tappet being formed by one of the two U-legs. On the inventive rail, the spaces and the key holes may be positioned in the area of the recess in the web. At the free ends of the U-legs, on the inventive rail in the area of the spaces, flaps bent inwards may be provided, which immediately prevent any axial insertion of the roller tappet into the corresponding space.

BRIEF DESCRIPTION OF THE DRAWING

The drawing shows exemplary embodiments of the invention and in the following said examples are explained in greater detail. Shown are.

DETAILED DESCRIPTION OF THE PREFERRED EMBODIMENTS

Figure 1:
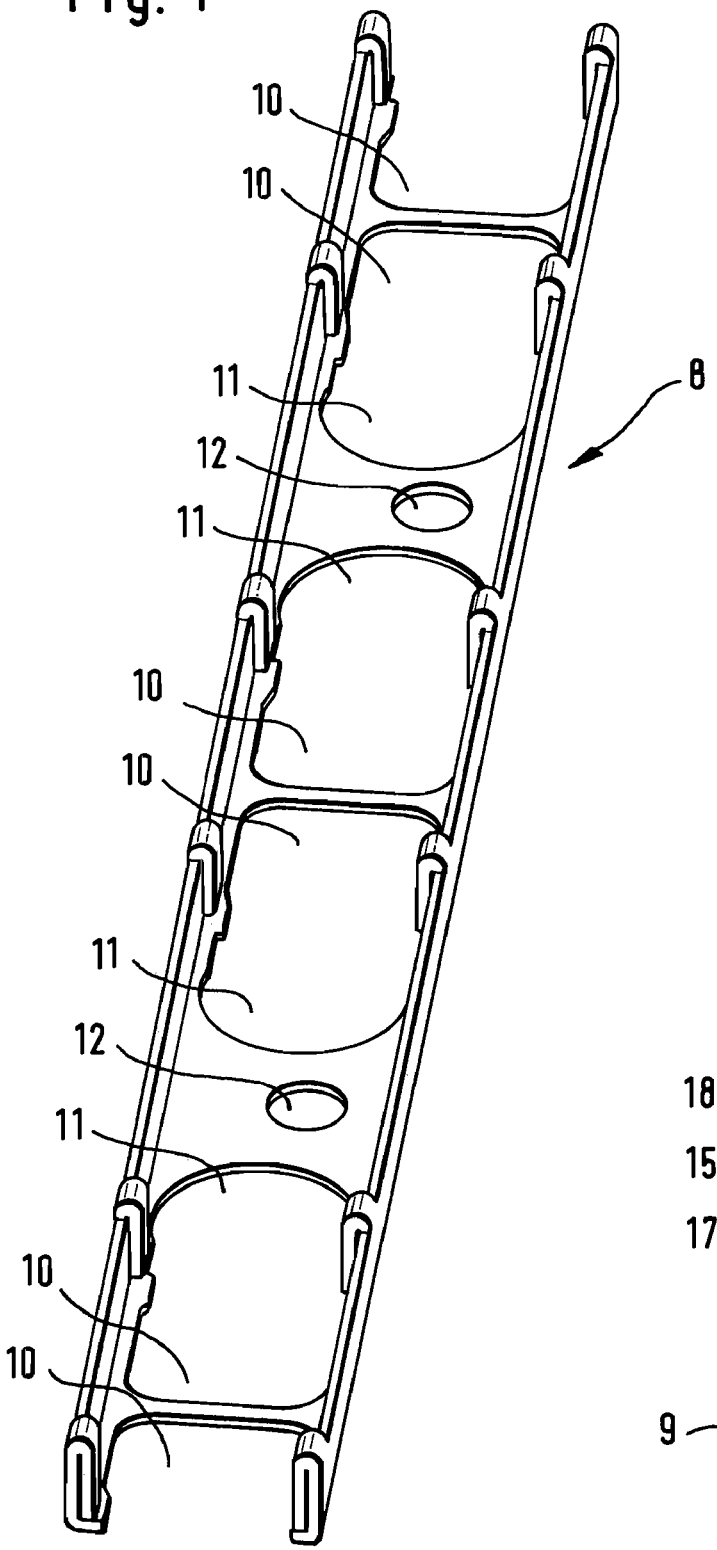
FIG. 1 a perspective view of a first embodiment of a rail used as an anti-rotation guide according to the invention.
Figure 2:
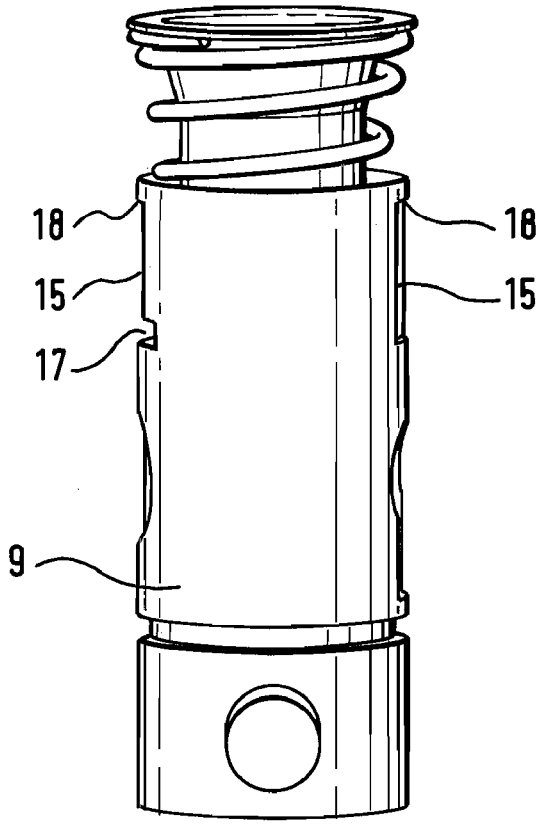
FIG. 2 a perspective view of a roller tappet according to the invention for the use in a rail used as an anti-rotation guide according to FIG. 1.
Figure 3:
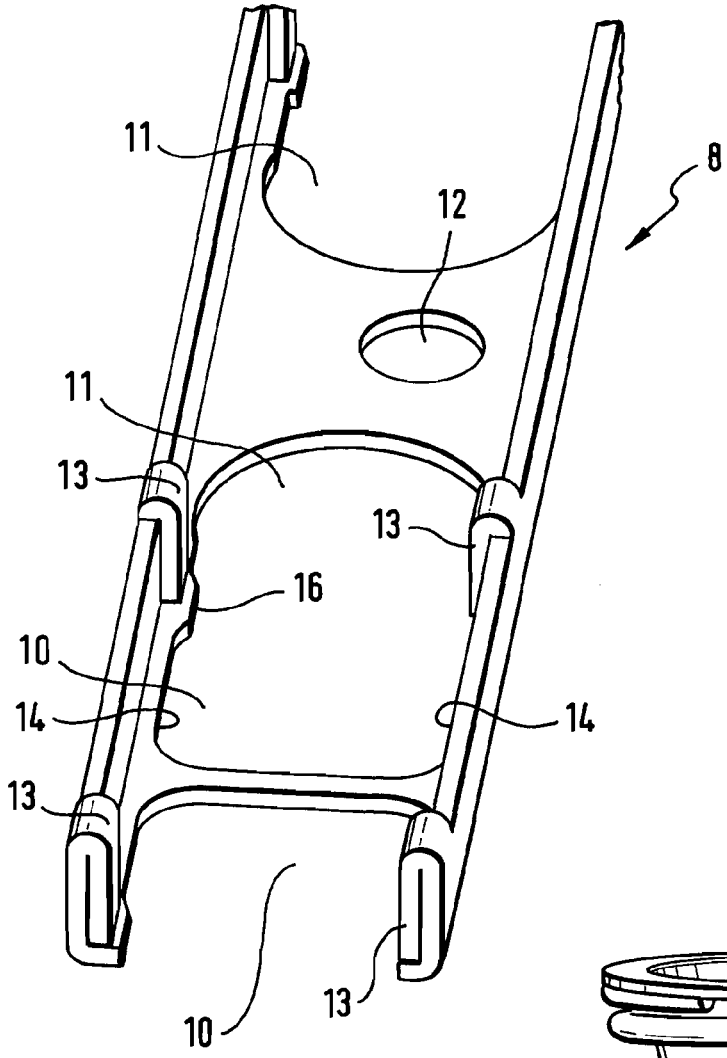
FIG. 3 an enlarged section of the rail used as an anti-rotation guide according to FIG. 1.
Figure 4:
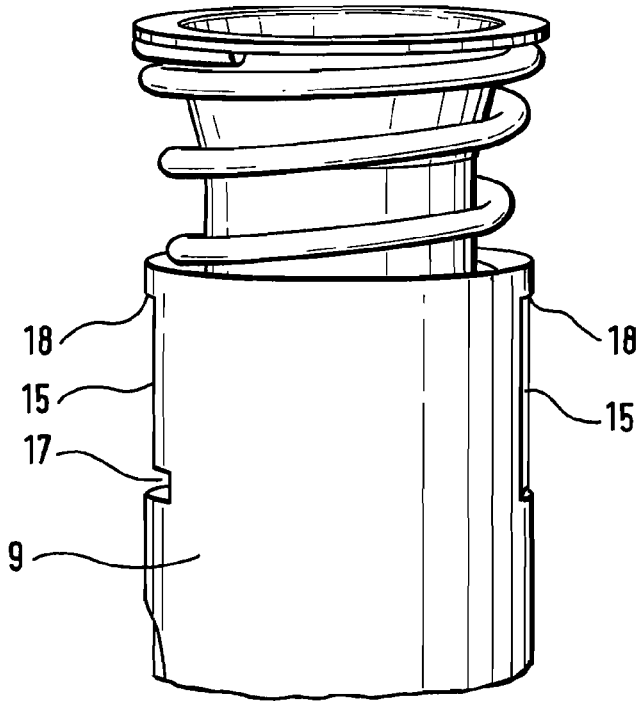
FIG. 4 an enlarged section of the roller tappet according to FIG. 2.
Figure 5:
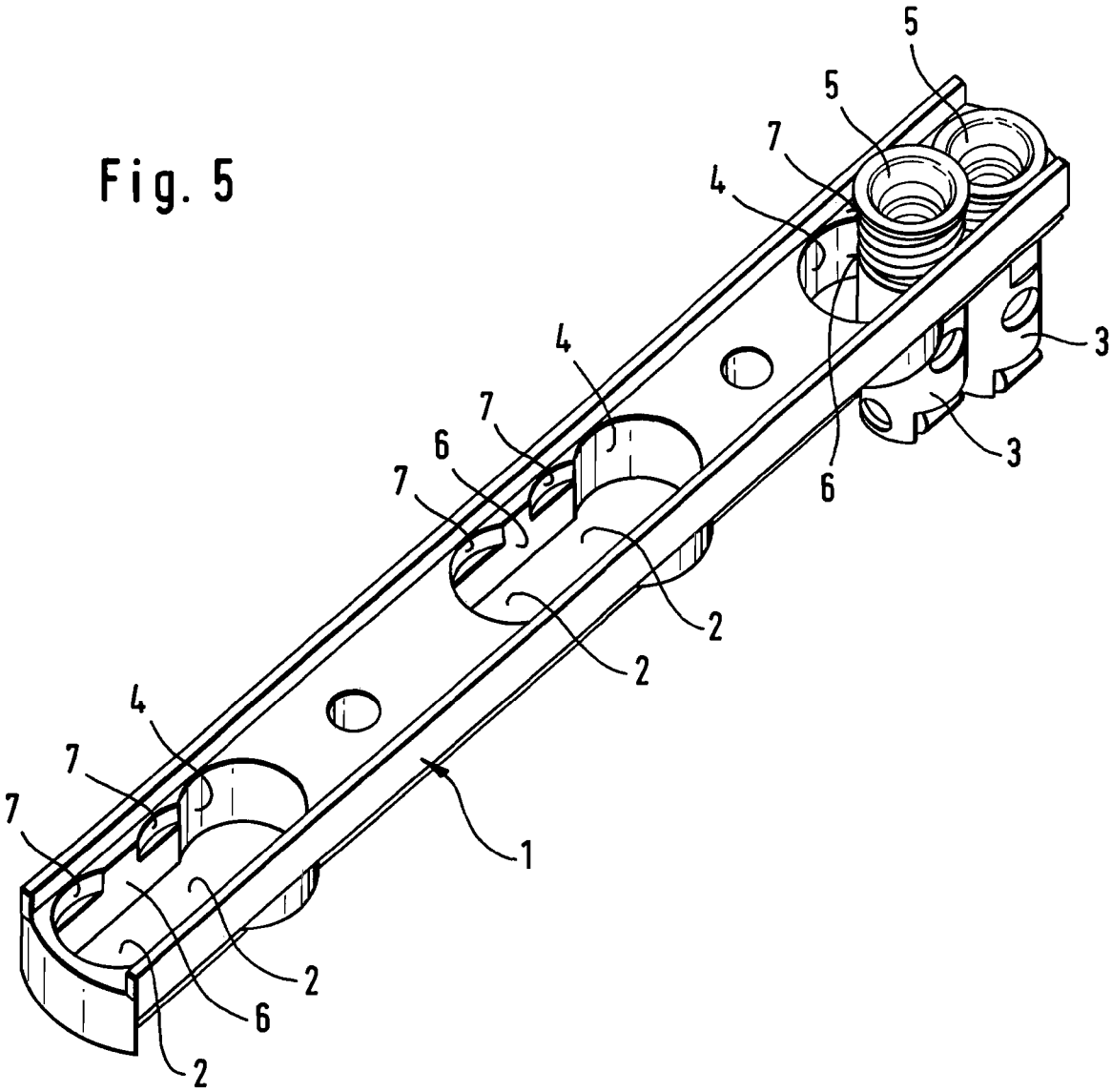
FIG. 5 a guide rail according to a prior suggestion of the applicant.

A rail used as an anti-rotation guide 8 shown in FIGS. 1 and 3 for roller tappets 9 according to FIGS. 2 and 4 is provided with spaces 10 arranged in a row spaced apart at a distance from one another, in which the two outermost spaces 10 are open towards the outside in the longitudinal direction of the inventive rail 8. An insertion opening called a key hole 11 is allocated to each additional space 10. Additionally, two bolt connection holes 12 are provided eccentrically in the inventive rail 8, i.e. off-set from the longitudinal central axis.

The inventive rail 8 is provided with two positioning flaps 13 at each key hole 11 and with two guide areas 14 at each space 10 for the cooperation with the anti-rotation guide areas 15 of the roller tappet 9. Additionally, a nose or catch 16 protruding into each of the spaces 10 is provided at the inventive rail 8. The roller tappet 9 is inserted in to the key hole 11 and passes with a groove 17 over the catch 16 during an axial displacement parallel out of the key hole 11 into the space 10. The groove 17 of the roller tappet 9 extends along said tappet in the area of an anti-rotation guide area 15 in a radial plane and its dimensions are complementary to the catch 16 of the inventive rail.

The two anti-rotation guide areas 15 of the roller tappet 9 are arranged as parallel surfaces at the casing of the roller tappet 9. At its upper end, two flush surfaces 18 of the roller tappet 9 are provided, extending in a common radial plane. After the parallel displacement of the roller tappet 9 into the space 10 of the inventive rail 8, the tappet is displaced downward in the axial direction, with the flush surfaces 18 coming into contact with the inventive rail 8. This ensures that the anti-rotation guide areas 15 of the roller tappet 9 and the guide areas 14 of the inventive rail 8 are engaging. The groove 17 prevents during the parallel displacement of the roller tappet 9, the tappet from falling out of the inventive rail 8. The vertical insertion of the roller tappet 9 at the entry of the key hole 11 is not necessary for those roller tappets 9 located at the two end faces of the inventive rail 8. A defined orientation of the tappet in reference to the inventive rail is provided with the solution according to the invention. The positioning flaps 13 prevent any attempts to insert the roller tappet 9 over the catch 16 not using the groove 17. After the insertion of the roller tappet 9, the anti-rotation guide areas 15 are always engaged, thus the roller tappet 9 can only be assembled in alignment with the inventive rail 8 and thus with the motor block.

A defined alignment of the inventive rail 8 in reference to the motor block is achieved such that the bolt mounting bores 12 have an eccentric, asymmetrical position in the inventive rail 8. This allows only one assembly position.

In the exemplary embodiment according to FIGS. 6 through 9, accepting spaces 20 are provided in a row at the inventive rail 19, which are each embodied as circular cylindrical openings. A flap 21 of the inventive rail 19 protrudes into each space 20. Here, the prevention of rotation of the inserted roller tappet 22 is achieved by a sheet metal plate 23 surrounding the tappet 22 and mounted thereto, that is provided with a recess 24, which after the insertion of the roller tappet 22 into the corresponding space 20 contacts the inventive rail 19 such that the flap 21 of the inventive rail 19 engages the recess 24 in the plate 23. Further, then the anti-rotation guide areas 25 contact the plate 23 at the guide surfaces 26 of the inventive rail 19. The anti-rotation guide areas 25 of the plate 23 are formed by two parallel lateral edges of the plate 23, formed as a rectangular component. Said component is eccentrically positioned and mounted on the roller tappet 22.

Figure 6:
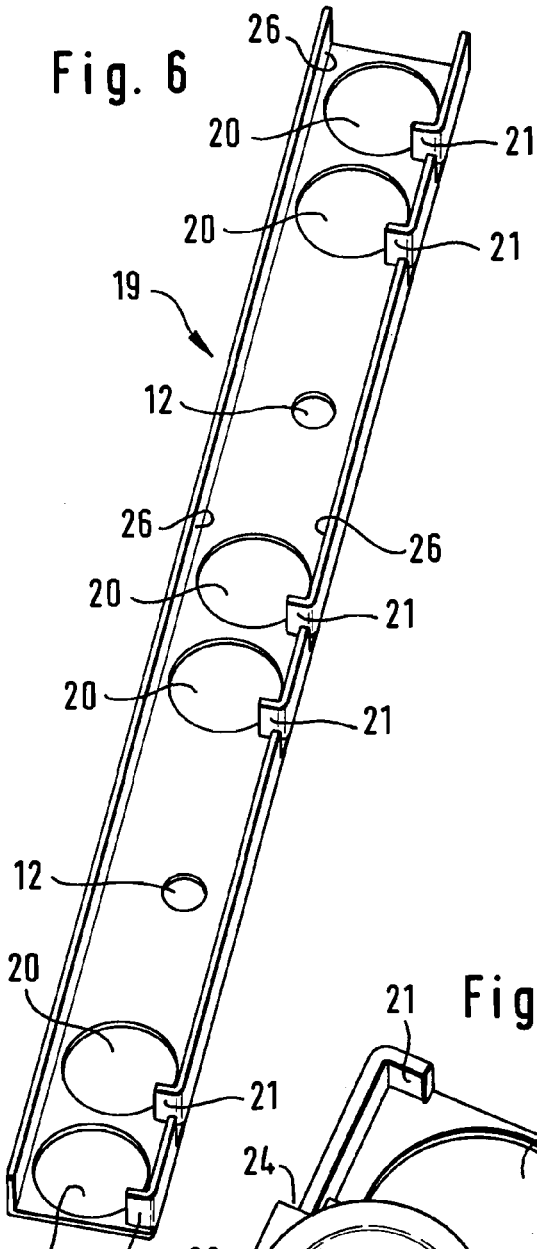
FIG. 6 a perspective view of another embodiment of a rail used as an anti-rotation guide according to the invention.
Figure 7:
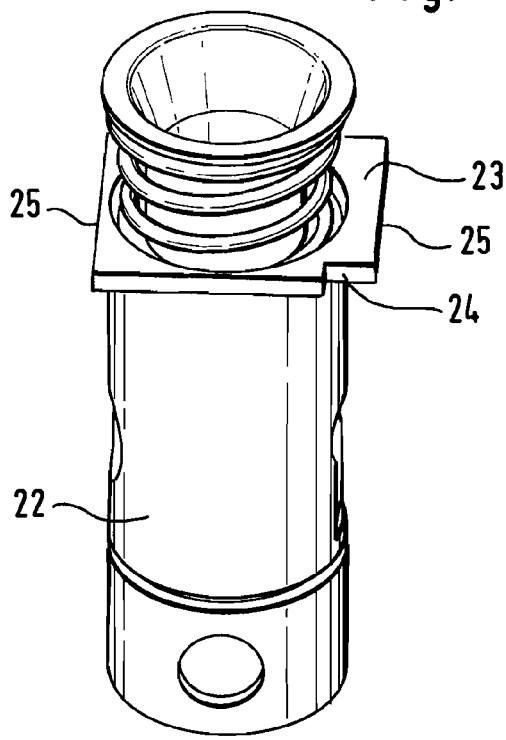
FIG. 7 a perspective view of a roller tappet according to the invention used in the rail used as an anti-rotation guide according to FIG. 6.
Figure 8:
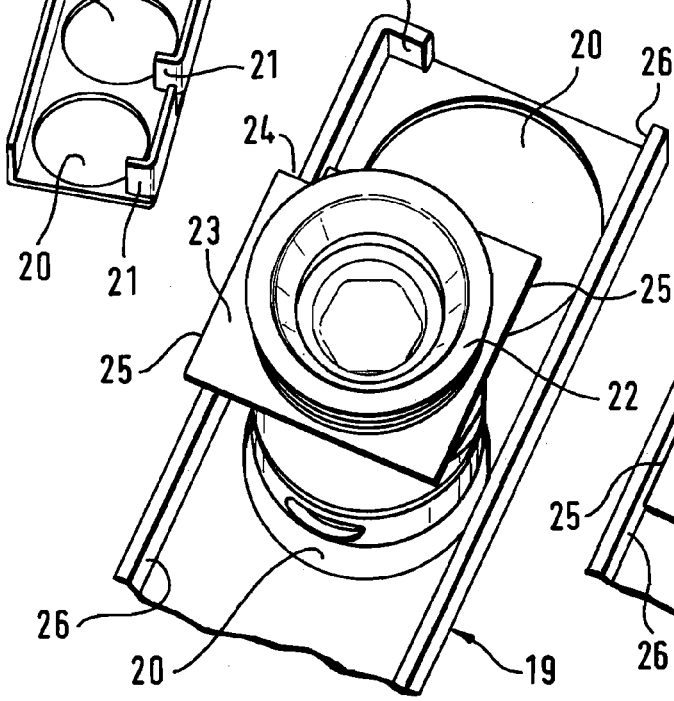
FIG. 8 an enlarged section shown in a perspective view of the rail used as an anti-rotation guide according to FIG. 6, having a partially inserted roller tappet.
Figure 9:
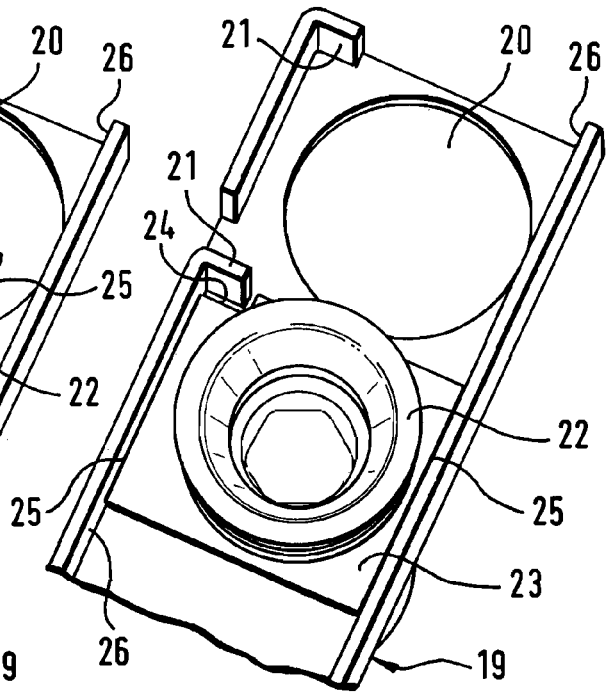
FIG. 9 a perspective view of a section of a rail used as an anti-rotation guide according to FIG. 8 with a roller tappet being inserted completely.

As discernible from FIGS. 6, 8, and 9, the flap 21, located in the proximity of the space 20 each, represents an area bent at a right angle away from a guide surfaces 26 of the inventive rail 19, fitting into the rectangular recess 24 of the plate 23. The recess 24 (FIG. 7) is arranged in a corner section of the plate 23.

The roller tappet 22 is inserted vertically from above downwards with its roll first into the space 20 of the inventive rail 19, until the piece 23 contacts the inventive rail 19. In this position it is ensured that the anti-rotation guide areas 25 of the plate 23 on the roller tappet 22 engage the guide surfaces 26 of the inventive rail 19. Due to the embodiment of the space 20, any lateral slip of the roller tappet 22 out of the inventive rail 19 is prevented.

Figure 10:
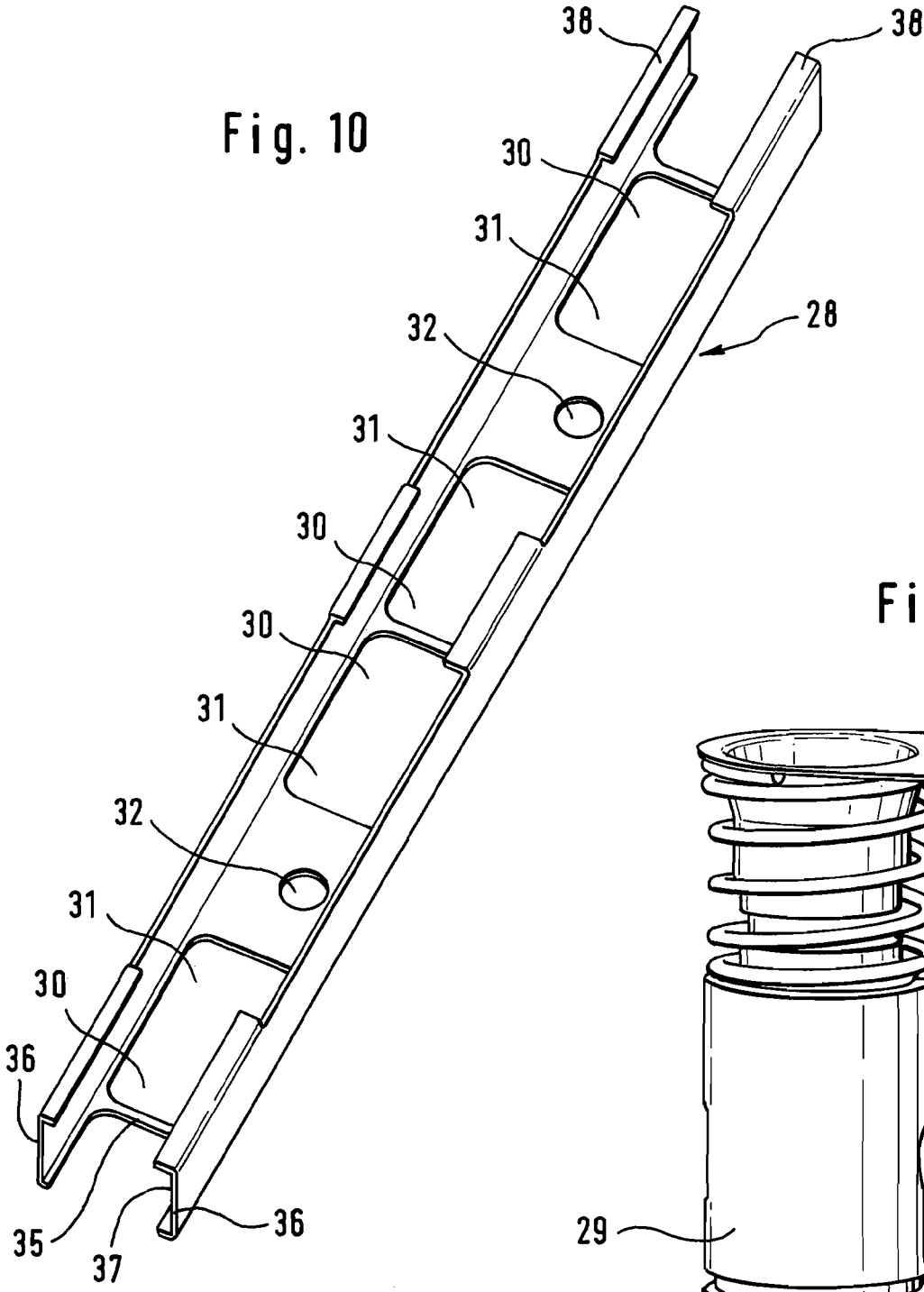
FIG. 10 a perspective view of another rail used as an anti-rotation guide according to the invention.
Figure 11:
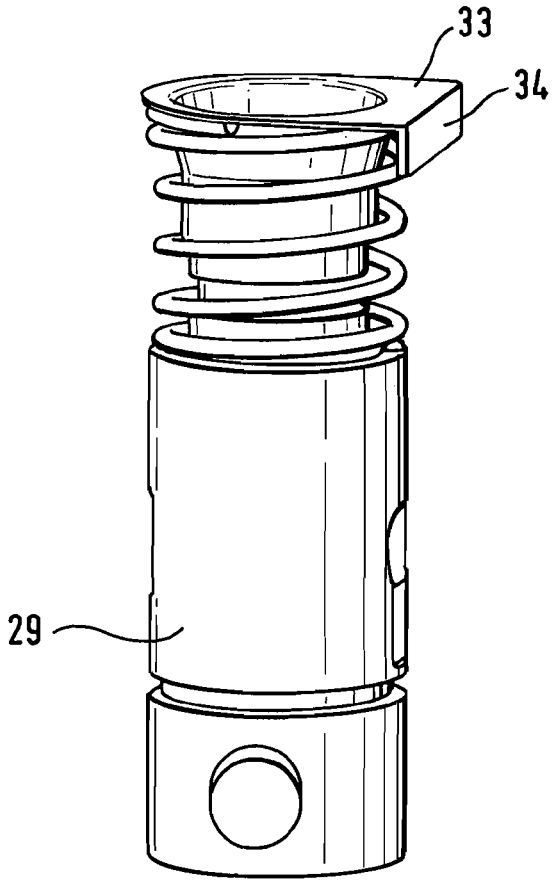
FIG. 11 a perspective view of a roller tappet according to the invention for the use in a rail used as an anti-rotation guide according to FIG. 10.
Figure 12:
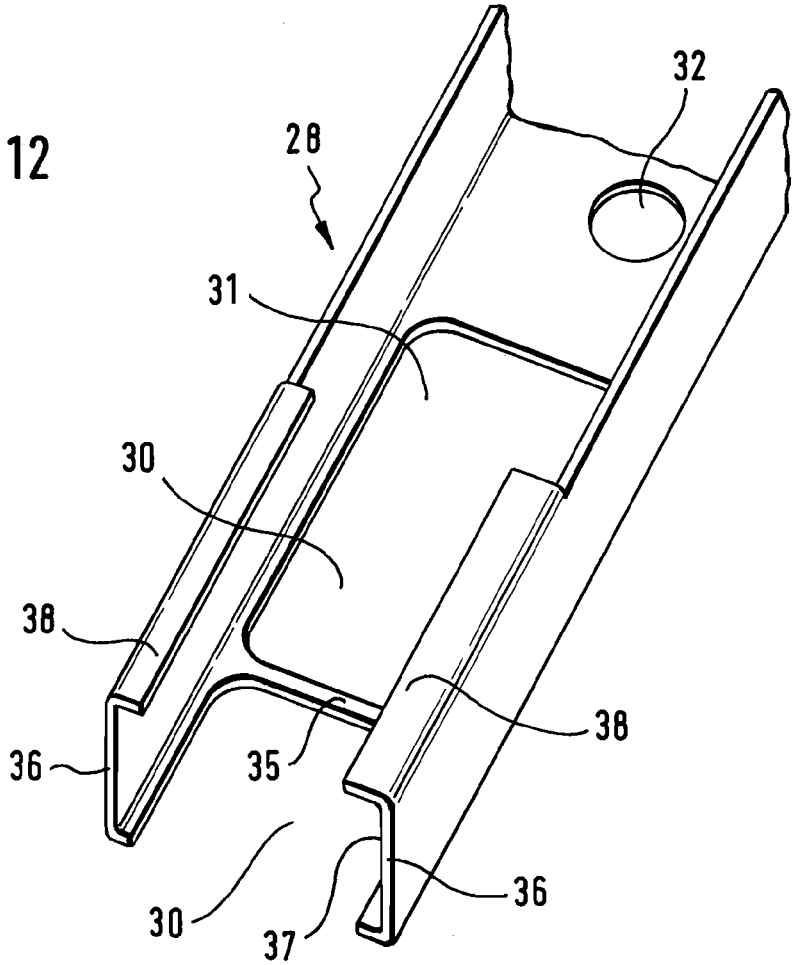
FIG. 12 an enlarged section of the rail used as an anti-rotation guide according to FIG. 10.
Figure 13:
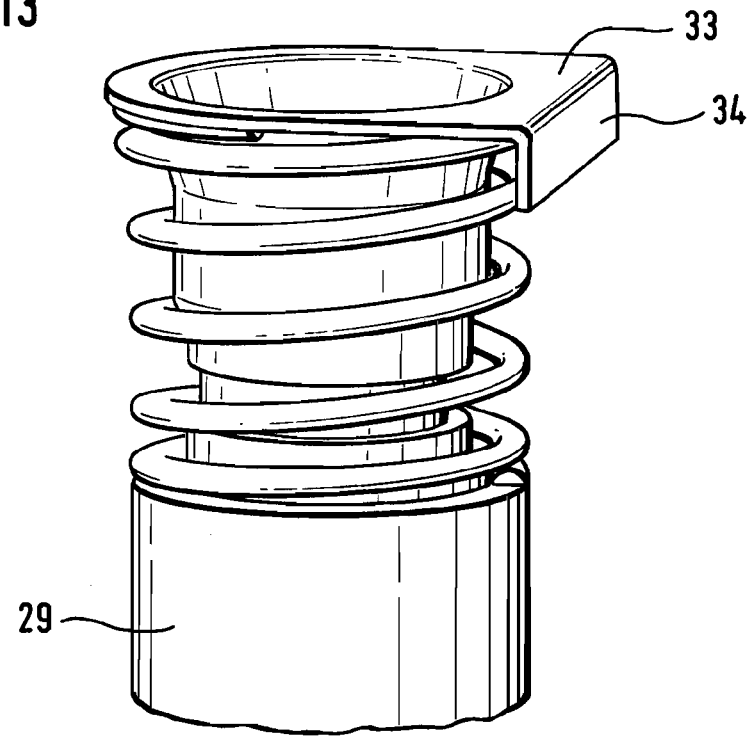
FIG. 13 an enlarged section of the roller tappet according to FIG. 11.
Figure 14:
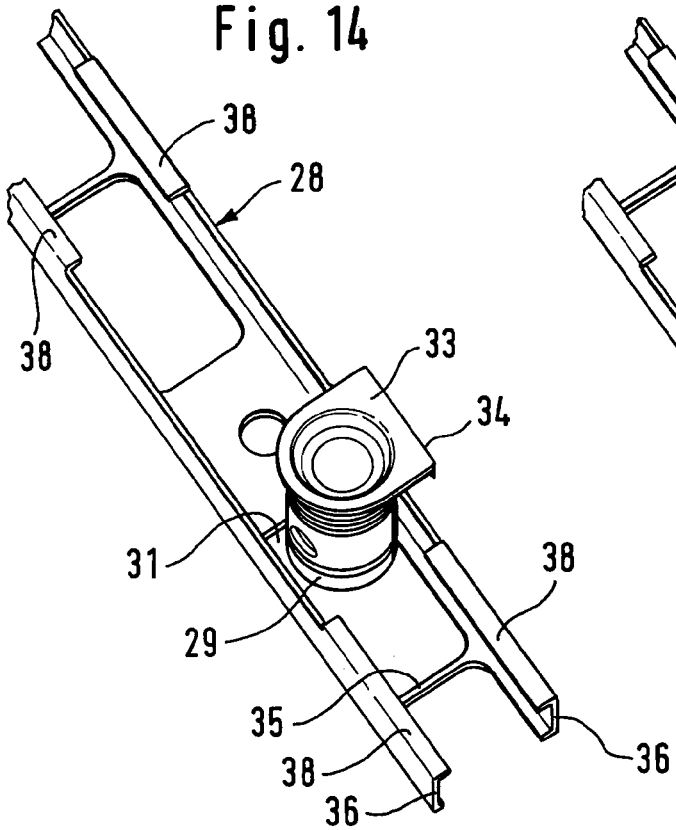
FIGS. 14-17 views showing the assembly of the roller tappet at another rail used as an anti-rotation guide in four sequential steps.
Figure 15:
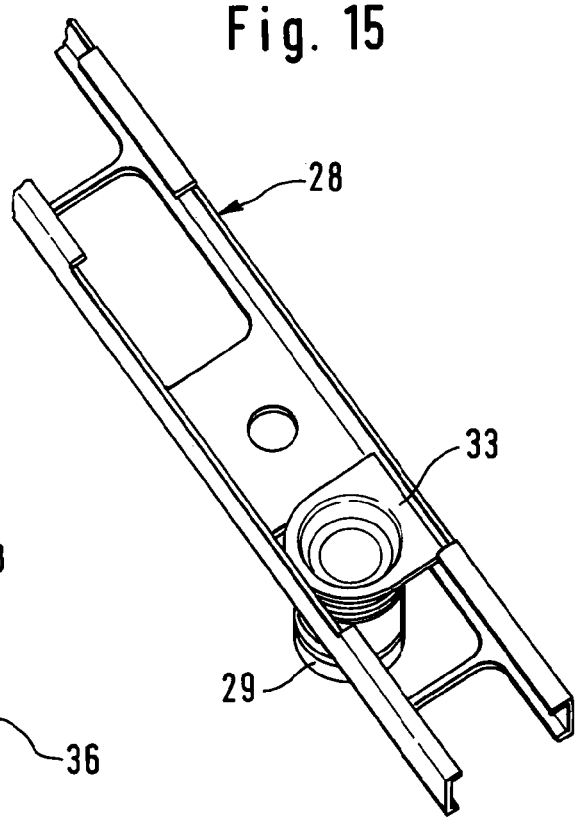
Figure 16:
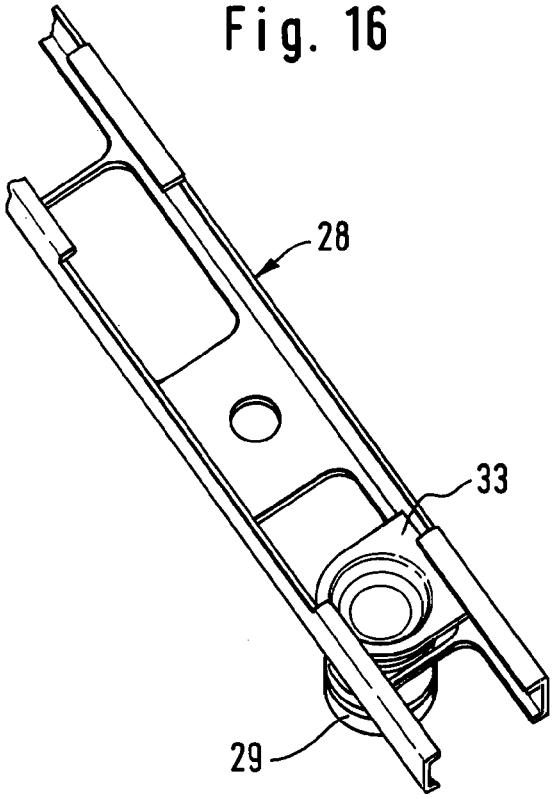
Figure 17:
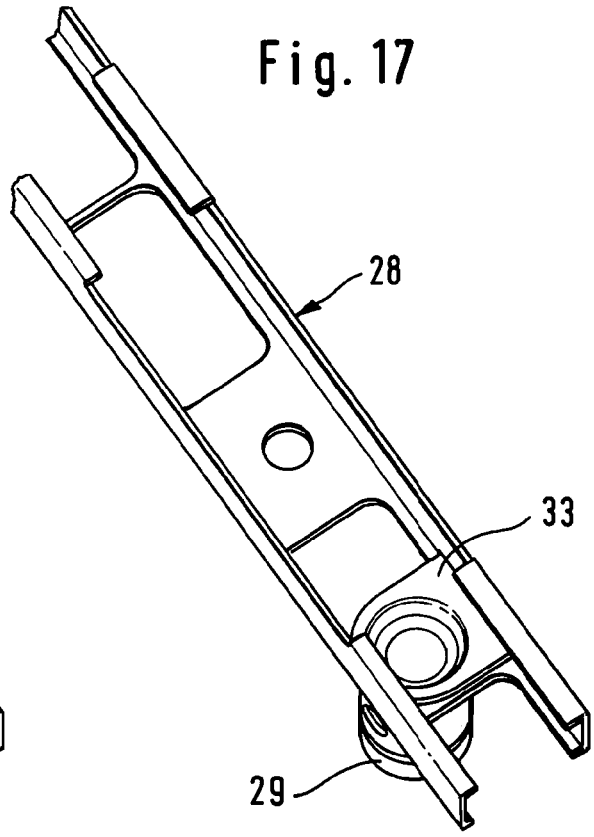

Another inventive rail 28 for roller tappets 29 according to the FIGS. 11 and 13 and shown in FIGS. 10 and 12 is provided with spaces 30 arranged in a row spaced apart at a distance from one another, with the two outermost spaces 30 being open in the longitudinal direction of the inventive rail 28. An insertion opening in the form of a key hole 31 is allocated to each additional space 30. Additionally, two bolt mounting holes 32 are provided eccentrically at the inventive rail 28, i.e. off-set from the longitudinal central axis.

In the embodiment according to the invention the back end of the roller tappet 29 is provided with a spring support 33, which is facing away from a tappet roller positioned at the front end. The flap is provided with a bent rectangular sheet metal strip, with its exterior plane surface acting as an anti-rotation guide area 34 for the roller tappet 29. The inventive rail 28 is provided with a U-shaped cross-section and has a U-web 35 and two adjacent U-legs 36. An interior surface of the two U-legs 36 operate as guide areas 37 for the anti-rotation guide area 34 of the inserted roller tappet 29. Additionally, at the upper free ends of the U-legs 36, bent towards the interior of the inventive rail 28, flaps 38 are arranged, which extend into the area of the spaces 30 only, so that an unhindered insertion of the respective roller tappets 29 into the corresponding key hole 31 is permitted.

During the assembly of the roller tappet 29 to the inventive rail 28 one roller tappet each extends vertically from the top downwards, inserted with the tappet roller first, through the key hole 31 into the inventive rail 28. Subsequently, the tappet 29 is displaced parallel in the longitudinal direction of the inventive rail 29 into the corresponding space 30 until it contacts the side of the adjacent U-legs 36. Then, it is axially lowered and contacts the U-web 35 of the inventive rail 28. This position ensures that the anti-rotation guide area 34 of the roller tappet 29 and the guide area 37 of the inventive rail 28 engage one another. At the two faces of the inventive rail 28, an insertion of the roller tappets 29 from above is not necessary because here the spaces 30 are open towards the outside in the longitudinal direction of the inventive rail 28.

The accepting spaces 30 with the key holes 31 ensure a defined alignment of the tappets 29 in reference to the inventive rail 28, with the key holes being arranged eccentrically in the inventive rail 28, on the one side, and the eccentric anti-rotation guide area 34 of the respective spring support 33, on the other hand. The flaps 38 position any roller tappet 29 potentially mounted faulty, into the inventive rail 28 in such a manner that the assembly of the rail is not possible with the pre-assembled roller tappets in the motor block. Any subassembly comprising an inventive rail 28 and six tappets 29 can only be assembled in the motor block if the tappets are positioned in the inventive rail in the above-described manner. In this case, the anti-rotation guide areas 34 of the roller tappets 29 and the guide areas 37 of the inventive rail 28 are engaging one another. Therefore, the roller tappet 29 can only be assembled in a single alignment in the inventive rail 28, and thus in the motor block.

A defined alignment of the inventive rail used as an anti-rotation guide 28 in reference to the motor block is achieved such that the bolt mounting bores 32 have an eccentric, asymmetrical position it the inventive rail 28. This allows one possible assembly only.

LIST OF REFERENCE CHARACTERS

1 guide rail
2 space
3 valve lifters
4 insertion bore
5 trumpet-shaped end
6 planar flattened zone
7 recess
8 inventive rail
9 roller tappet
10 space
11 key hole
12 bolt mounting hole
13 positioning flap
14 guide area
15 anti-rotation guide area
16 catch
17 groove
18 flush surface
19 anti-rotation guide area
20 space
21 flap
22 roller tappet
23 sheet metal plate
24 recess
25 anti-rotation guide area
26 guide surface
28 inventive rail
29 roller tappet
30 space
31 key hole
32 bolt mounting hole
33 spring support
34 anti-rotation area
35 U-bar
36 U-leg
37 guide area
38 flap

The invention claimed is:

1. An arrangement of roller tappets on a rail used as an anti-rotation guide for the valve train of an internal combustion engine, comprising accepting spaces arranged in a row spaced apart at a distance from one another in the rail for accepting inserted valve lifters provided as roller tappets, each of the roller tappets having one planar anti-rotation guide area in order to prevent rotation of the roller tappet around a central longitudinal axis thereof, the anti-rotation guide area is supported at a guide area of the rail located inside of a corresponding one of the accepting spaces, and the accepting spaces having an associated insertion opening key hole, into which the respective roller tappet is inserted in a direction of the longitudinal axis thereof, subsequently displaced parallel to the axis towards the accepting space, and then displaced again in an axial direction, the anti-rotation guide area of the roller tappet is formed by a bent sheet metal strip of a spring support, which is arranged at a back end of the roller tappet facing away from the tappet roller.

2. An arrangement according to claim 1, wherein the rail used as the anti-rotation guide is provided with a U-shaped cross-section having a U-web and two U-legs, with the guide area for the roller tappet being formed by one of the two U-legs.

3. An arrangement according to claim 1, wherein the spaces and the key holes are arranged in an area of the recesses of the U-web in the rail used as the anti-rotation guide.

4. An arrangement according to claim 1, wherein inwardly bent flaps are arranged on the rail in an area of the accepting spaces at the free ends of the U-legs, each of which prevents an axial insertion of the roller tappet into the corresponding accepting spaces.

* * * * *